United States Patent [19]

Kato et al.

[11] Patent Number: 5,018,461

[45] Date of Patent: May 28, 1991

[54] LABEL SUPPLY APPARATUS AND LABEL SUPPLY METHOD

[75] Inventors: Katsuyuki Kato, Nagoya; Zinichi Yaguchi, Kani, both of Japan

[73] Assignee: Kabushikikaisha Barudan, Aichi, Japan

[21] Appl. No.: 480,716

[22] Filed: Feb. 15, 1990

[30] Foreign Application Priority Data

| | | | |
|---|---|---|---|
| Apr. 18, 1989 | [JP] | Japan | 1-98474 |
| May 15, 1989 | [JP] | Japan | 1-121761 |
| Dec. 21, 1989 | [JP] | Japan | 1-331684 |

[51] Int. Cl.[5] ..... D05B 3/12; D05B 3/22

[52] U.S. Cl. ..... 112/104; 112/113; 112/130; 112/262.3; 112/265.1

[58] Field of Search ..... 112/104, 113, 121.27, 112/152, 130, 114, 262.3, 265.1

[56] References Cited

U.S. PATENT DOCUMENTS

| | | | |
|---|---|---|---|
| 1,210,761 | 1/1917 | Chatfield | 112/113 X |
| 1,319,450 | 10/1919 | Allen et al. | 112/130 |
| 2,548,692 | 4/1951 | Vollman et al. | 112/104 |
| 3,752,099 | 8/1973 | Hunter, Jr. et al. | 112/121.27 |
| 4,967,675 | 11/1990 | Goldbeck et al. | 112/104 X |

FOREIGN PATENT DOCUMENTS 63-281681 5/1987 Japan .

*Primary Examiner*—Werner H. Schroeder
*Assistant Examiner*—Paul C. Lewis
*Attorney, Agent, or Firm*—Pollock, Vande Sande & Priddy

[57] ABSTRACT

A label push-in element is provided under a label placed at a label rest position and a label retainer is disposed over the label. The push-in element is advanced upwards to force the intermediate portion of the label into the retainer and is retreated after the retainer has clipped the label. The retainer is moved horizontally to a sewing position over a cloth spread on a sewing machine table. While the retainer is moved the end portions of the label protruding from the retainer hits such an object near the sewing position as the edge of the table or the cloth and is folded towards the direction opposite to that of movement of the retainer. The end portions overlapped on the edge of the cloth are sewn by a sewing machine.

7 Claims, 9 Drawing Sheets

LABEL SUPPLY APPARATUS AND LABEL SUPPLY METHOD

BACKGROUND OF THE INVENTION

1. Field of the Invention

This invention relates to a label supply apparatus and a label supply method for supplying a label having an indication part such as size indication or cleaning indication which is sewn onto a cloth in the form of a towel, a suit or the like. More particularly, the invention relates to a label supply apparatus and a label supply method for supplying the label in such a manner that a sewing end portion of the label is overlapped on the edge of the cloth and the indication part is placed over the cloth inside the edge.

2. Description of the Prior Art

A conventional label supply apparatus may have the following construction. Namely, the label supply apparatus has a label retainer adapted to move back and forth between a label rest position and a label sewing position. The retainer comes to the label rest position and clips a portion of the label. The retainer clipping the label moves forth toward the label sewing position and overlaps the forward end portion of the label upon a prescribed sewing portion of the cloth. The overlapped end portion is sewn by a sewing machine. As such an apparatus, there is one disclosed, for example, in Japanese published unexamined patent application No. 63-281681.

When the above mentioned cloth is wide one, it is spread, in general, on a table placed in front of the sewing machine in order to smoothly feed the cloth during sewing. When the sewing end is sewn onto the edge of such spread cloth with the indication part of the label positioned over the cloth inside the edge, the above mentioned conventional label supply apparatus is positioned over said table. The label supply apparatus placed at such a position, however, obstructs work on the cloth on the table such as to spread the cloth on the table.

SUMMARY OF THE INVENTION

One object of the present invention is to provide an apparatus wherein a label can be supplied for the purpose of sewing the label onto a cloth in a situation that a sewing end portion of the label is overlapped upon a prescribed sewing edge of the cloth, and an indication part of the label is positioned over the cloth inside the edge.

Another object of the present invention is to provide an apparatus wherein the label can be supplied from outside the prescribed sewing edge when the label is appropriately positioned. The apparatus capable of supplying the label in this manner can be installed at a position close to the above mentioned edge in an out of the way space over a table to support the cloth. Thus the space over the table remains empty and the work efficiency of working with the cloth on the table is improved.

In the apparatus according to the present invention, a part of the label at a label rest position is inserted into a retainer by a push-in element. The retainer clips the inserted part of the label. The retainer is moved towards a sewing position. In the process of this movement of the retainer, the end portion of the label protruding from the retainer hits the table or the edge of the cloth and is folded in the direction opposite to the direction of the movement of the retainer. This end portion is then overlapped upon the prescribed sewing edge of the cloth. In this situation, the part of the label clipped by the retainer is positioned over the cloth inside the edge.

Another object of the present invention is to provide a label supply apparatus and a label supply method which can make it possible to supply a label with the length of the end portion of the label protruding from the retainer fixed even though the length of the label to be supplied is changed. If the length of this end portion is constant, the sewing end portion of the label can be accurately put on the edge of the cloth only by moving the retainer to a prescribed position whatever the length of the label to be supplied may be. This makes it possible to simplify the structure for moving the retainer towards the sewing position and makes the control of the movement of the retainer simple.

Still another object of the present invention is to provide a label supply apparatus and a label supply method which can make it possible to supply either a onefold label or a twofold label with the length of the portion of the label protruding from the retainer fixed constant.

DESCRIPTION OF THE PREFERRED EMBODIMENTS

Figure 1:
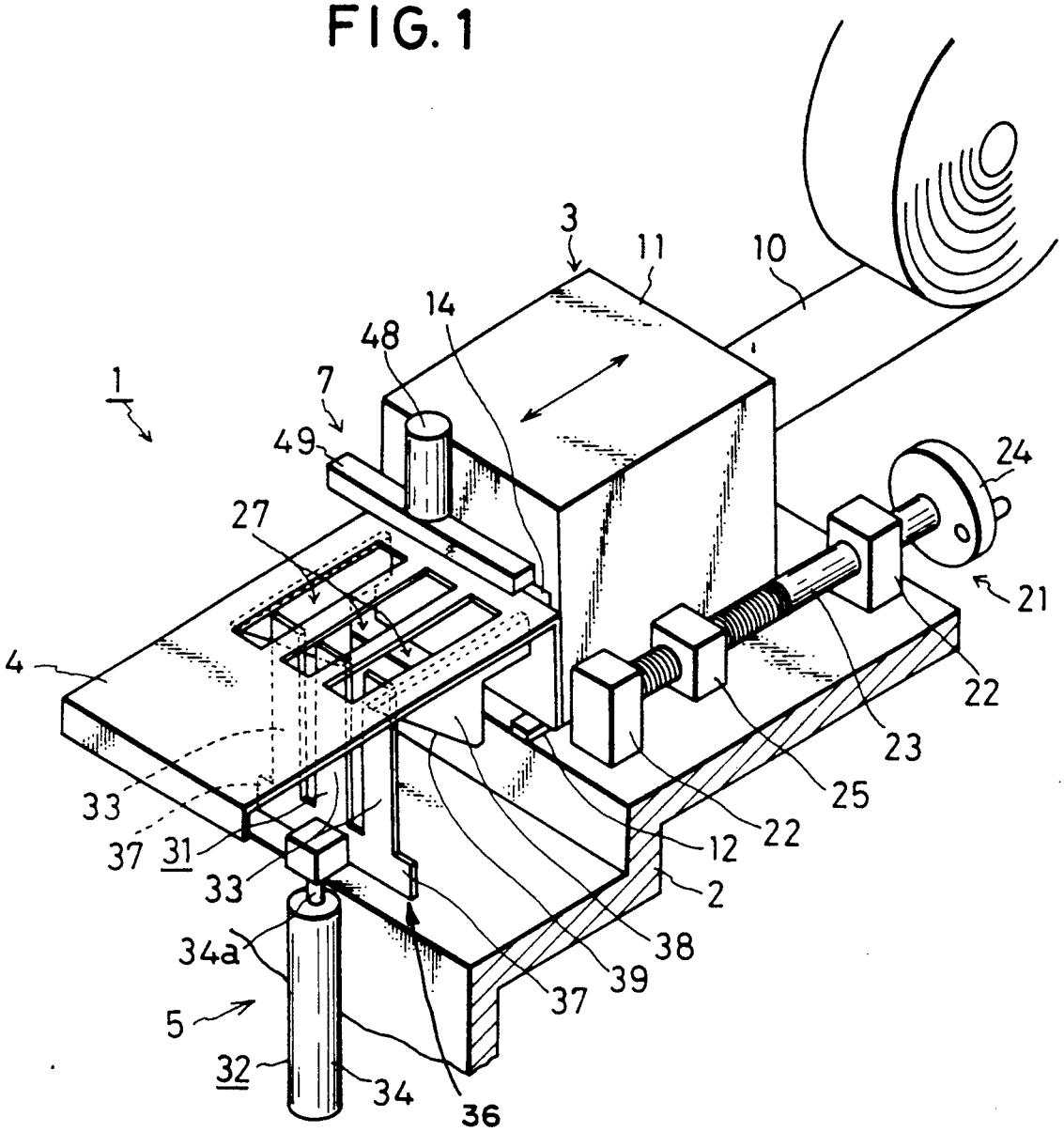
FIG. 1 is a perspective view showing a first embodiment of a label supply apparatus.
Figure 3:
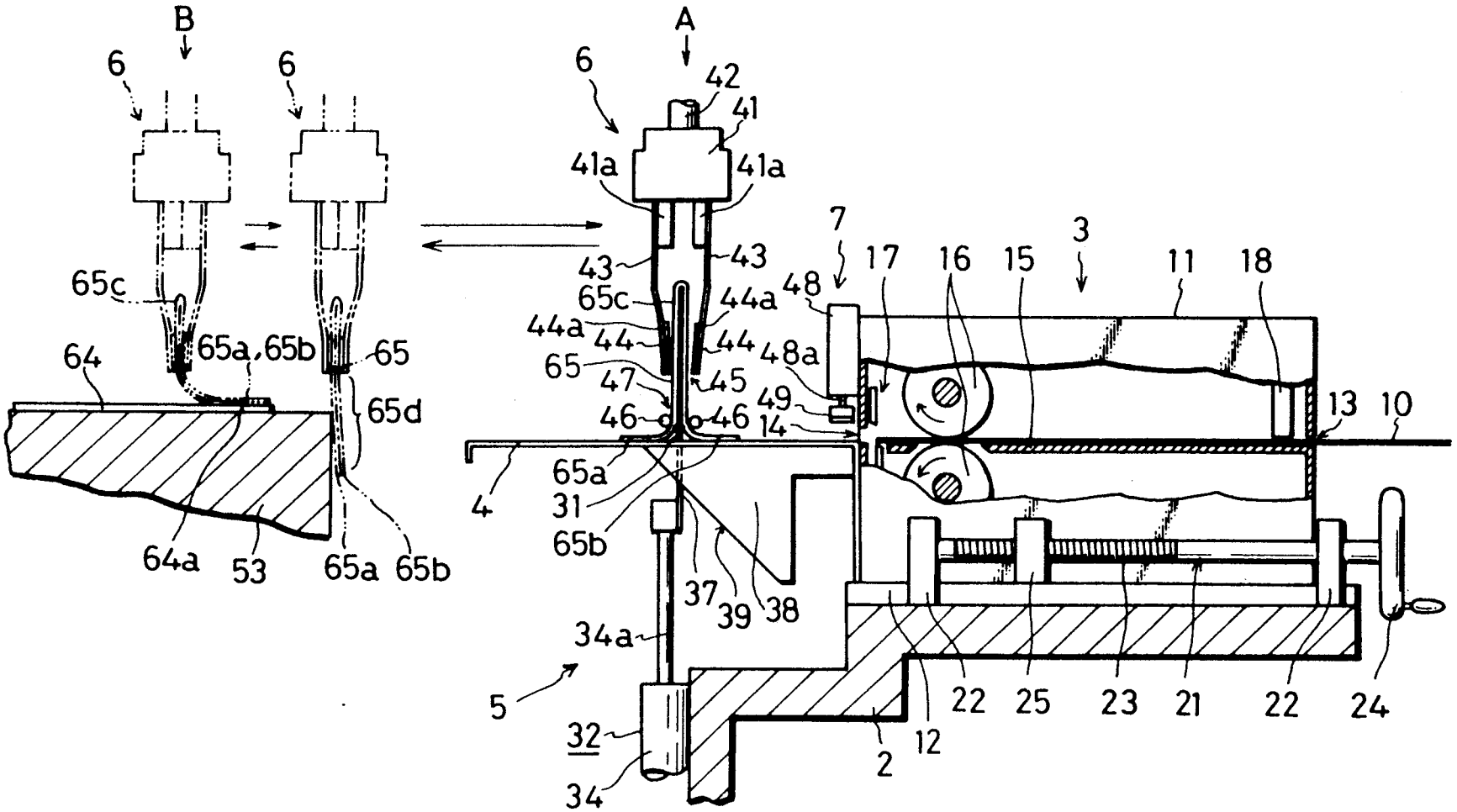
FIG. 3 is a view showing the positional relationship between the label supply apparatus and the label sewing apparatus and showing the construction of the label supply apparatus in partial section.

In FIGS. 1 and 3 showing a first embodiment of a label supply apparatus according to the present invention, the label supply apparatus 1 comprises a base frame 2, a cutting means 3 mounted on the base frame 2, a label table 4 formed with the upper surface thereof acting as a label rest position to put a label thereon, a label push-in means 5 provided under the label table 4, a retainer 6 provided over the label table 4 and a label restricting means 7 to restrict a part of the label on the label table 4.

The cutting means 3 cuts a long strip 10 into labels and prepares the cut off labels on the label table 4. In what follows this cutting means 3 is explained. A housing 11 of the cutting means 3 is mounted for movement along a rail 12 on the base frame 2 in the direction shown by an arrow in FIG. 1. The housing 11 is formed at one side thereof with an inlet 13 for the strip 10 and at the opposite side thereof, with an outlet 14. The housing 11 includes therein a support plate 15 adapted to receive the strip 10 between the inlet 13 and the outlet 14 and to simultaneously guide the movement of the strip 10. In the housing 11 are further provided a pair of feed rollers 16. These feed rollers 16 with the strip 10 clamped therebetween are rotated in the directions shown by arrows in the figure by a drive motor not shown. The strip 10 is pulled in through the inlet 13 and pushed out through the outlet 14 by the rotation of the feed rollers 16. A cutter 17 to cut the strip 10 is provided near the outlet 14 in the housing 11. A mark sensor 18 to detect cutting marks which are attached on the strip 10 for indicating cutting positions is provided near the inlet 13 along the path of the strip 10. The strip 10 consists of many label elements connected in a series which are to be shaped into separate labels by cutting the strip. The above-mentioned mark is attached on each border between two adjacent label elements. Accordingly, the spacing between two adjacent marks on a strip 10 consisting of long label elements (a strip for producing long labels) is long, and short on a short strip 10 (a strip for producing short labels). An example of the strip 10 is a textile tape. Another example is a smooth tape made of synthetic resins. The drive motor for the feed rollers 16 and the sensor 18 are connected to a control means not shown. The control means operates to rotate the drive motor and receives a signal from the sensor 18 when it detects the mark. The control means operates to stop the drive motor when the feed rollers 16 have fed the strip 10 to a distance at which the detected mark comes to the position of the cutter 17.

A transfer means 21 is provided in order to move the housing 11 along the rail 12. The transfer means 21 includes a pair of bearings 22 and 22 secured at the base frame 2, a feed rod 23 supported by the bearings 22 and 22 rotatably, a handle 24 to rotate the feed rod 23 and a transfer element 25 secured on the housing 11. The feed rod 23 is a threaded rod in a threaded engagement with a tapped hole formed in the transfer element 25. When the feed rod 23 is rotated by turning the handle 24, the transfer element 25 is moved along the feed rod 23 and as a result the housing 11 is moved along the rail 12.

In the present embodiment, the label table 4 is connected to the housing 11 of the cutting means 3 and is adapted to be moved together with the housing 11 by the transfer means 21. A plurality of slits 27 are formed in the label table 4 and are adapted to enable a push-in element to be described hereinafter to pass through the label rest position. As shown in FIG. 1, any of the slits 27 is formed to be elongated in the direction of the movement of the table 4 by the transfer means 21.

Figure 4A:
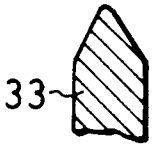
FIGS. 4A and 4B are sections showing the forms of the end portions of a push-in tooth.
Figure 4B:
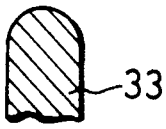

The aforementioned push-in means 5 comprises a push-in element 31 and a reciprocation means 32 to put the push-in element 31 in reciprocating motion. The push-in element 31 with plural push-in teeth 33 is made in the form of a comb. The width of each push-in tooth 33 is such a value that each tooth can pass through the slit 27 of the table 4. The free end portion of each push-in tooth 33 is of wedge-like form and the tip is slightly rounded shown in FIG. 4A. The free end portion, however, may be shaped as shown in FIG. 4B. The reciprocation means 32 in this embodiment is an air cylinder 34 mounted on the base frame 2. The push-in element 31 is secured on the top of a piston rod 34*a* in the air cylinder 34.

A ruler or prescription means 36 is provided in order to limit the forward stroke of the push-in element 31 within a prescribed value. This ruler means 36 comprises an abutting member 37 formed integrally on both sides of the push-in element 31 and a stop member 38 secured on the label table 4. The stop member 38 is formed with a stop surface 39 at the side thereof opposing the abutting member 37. The stop surface 39 has a level of 45° relative to the line of the movement of the label table 4.

Next, the retainer 6 is explained. A body 41 of the retainer 6 is mounted on a well known carrier means 42 (only a part is shown). The retainer 6 is put into reciprocating motion between a retaining position A and a sewing position B as shown in FIG. 3. The body 41 is provided with movable pieces 41*a* and 41*a* adapted to move near or away from each other. Each movable piece 41*a* is provided with a retaining piece 43 made of a elastic material. The top of each retaining piece 43 forms a retaining portion 44. On the retaining piece 44 is attached an antislipping member 44*a* (for example a rubber piece) which can cause a large friction force on the label. The space between the retaining portions 44 and 44 forms a label receiving portion 45. The retaining position A is determined to be at a place where the label receiving portion 45 opposes the push-in element 31 so that the label pushed out by the push-in element may be received into the label receiving portion 45. Label guides 46 are provided close by the label table 4. The label guides 46 are secured on the base frame 2 though not shown. The label guides 46 and the label table 4 are separated by a spacing through which the label can pass. A spacing 47 to allow the passage of the push-in element 31 is left between the label guides 46 at a place where the label guides 46 oppose the push-in element 31. If the top of the retaining piece 43 is positioned sufficiently close by the label table 4 when the retainer 6 is positioned at the retaining position A, the label guides 46 may be omitted.

The above mentioned label restricting means 7 comprises an air cylinder 48 secured on the housing 11 and a press bar 49 attached on the top of the pistonrod 48*a* of the air cylinder 48.

Figure 2:
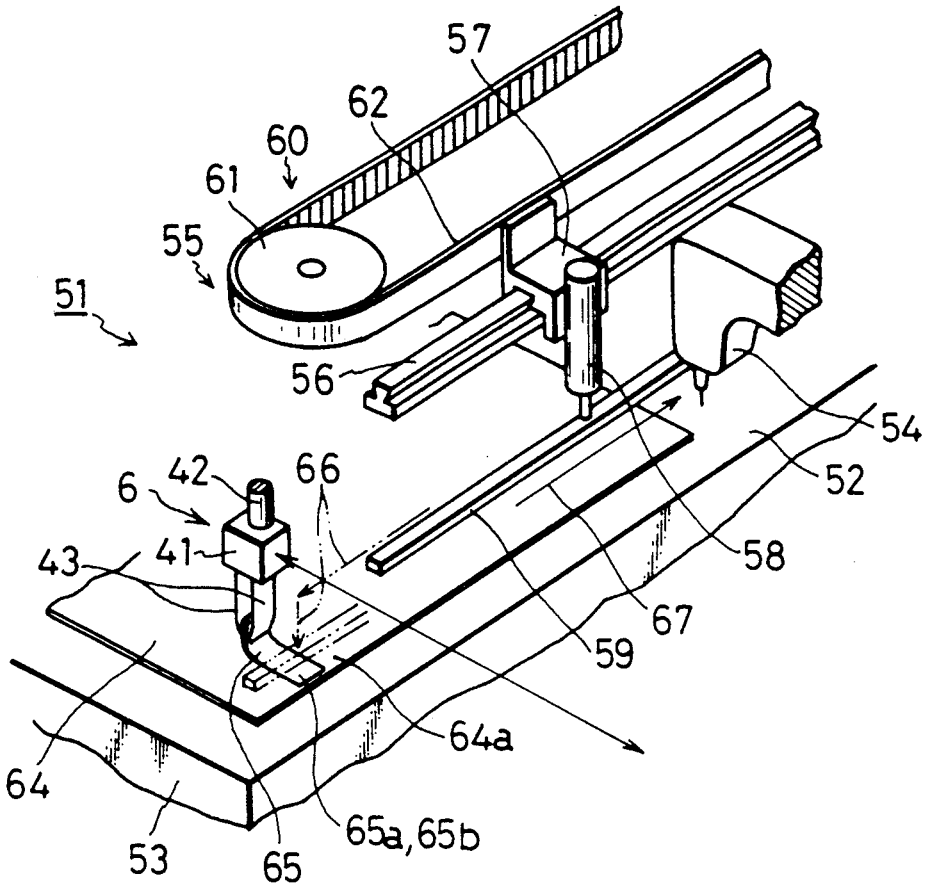
FIG. 2 is a perspective view of a label sewing apparatus.
Figure 5:
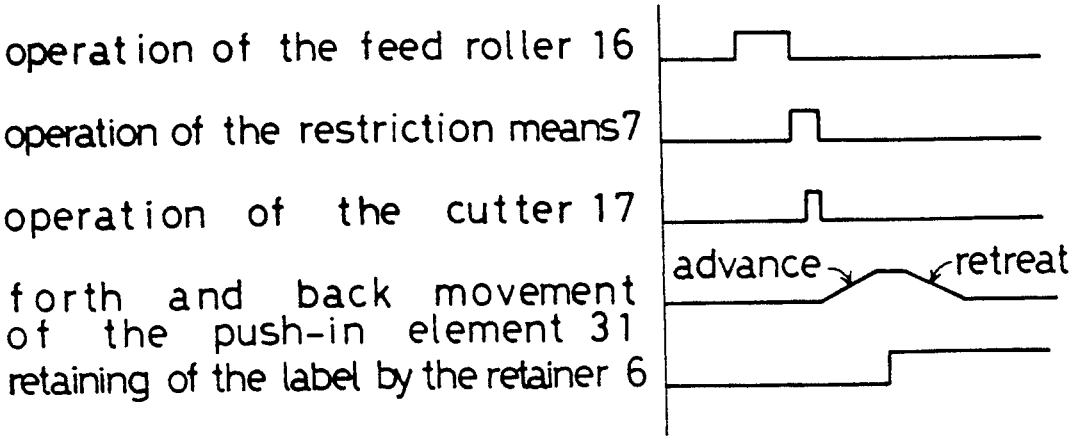
FIG. 5 is a timing chart showing the operation sequences of various portions of the label supply apparatus of FIG. 1 in the case when a twofold label is supplied by the label supply apparatus.

Now in FIG. 2 is shown a label sewing means 51 as an example of a means to receive supplied labels. The means 51 comprises a machine table 52, a cloth receive table 53 formed integrally with the machine table 52, a machine head 54 provided over the machine table 52 and a transfer means 55 for transferring a cloth with a label to be sewn thereon from the cloth receive table 53 towards the machine table 52. The transfer means 55 includes a guide rail 56. A movable frame 57 is mounted on the guide rail 56 for movement along the rail. An air cylinder 58 is mounted on the movable frame 57 and a cloth presser bar 59 is attached to the lower end of the pistonrod of the air cylinder 58. On the lower surface of the cloth presser bar 59 is attached an antislipping layer (for example a thin strip of rubber) causing a large friction force on the cloth. A feed mechanism 60 is connected to the movable frame 57. The feed mechanism 60 comprises a pulley 61 and a belt 62 (for example a cogbelt is used) fastened on the pulley 61 and a connection piece of the movable frame 57 is secured on the belt 62.

The supply of the label to the label sewing means 51 by the label supply apparatus 1 and the sewing of the supplied label in the label sewing means 51 will now be explained. In the label sewing means 51, a cloth 64 on which the label is to be sewn is put in spread state on the table 53. An edge 64*a* of the cloth 64 is a part on which a sewing end portion of the label is sewn. In this situation, the label is supplied by the label supply apparatus 1 in the following manner.

Figure 6A:
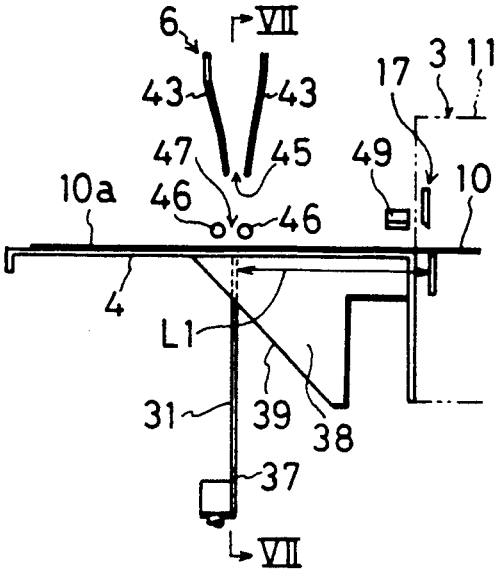
FIGS. 6A and 6B are views for explaining the operation of the push-in element in the case when a long twofold label is supplied by the label supply apparatus of FIG. 1.
Figure 6B:
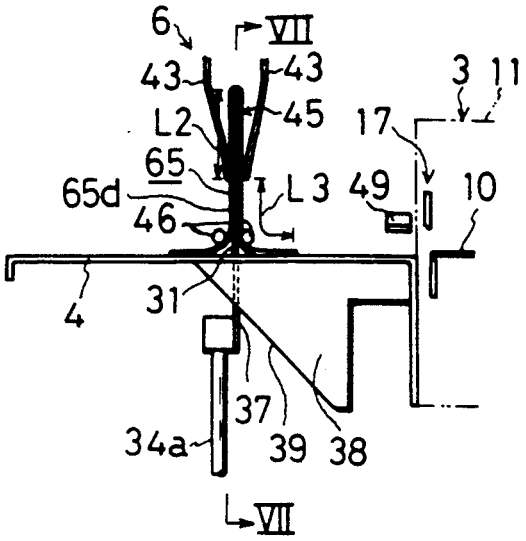
Figure 7A:
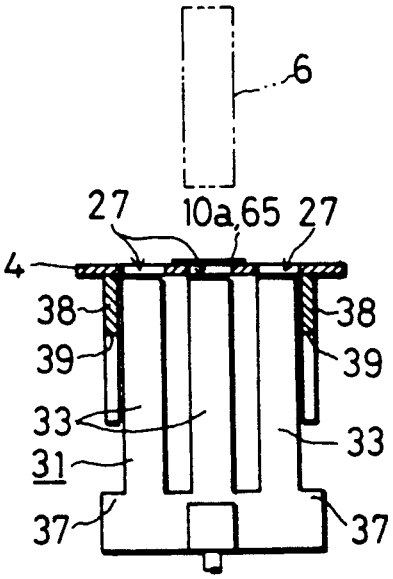
FIGS. 7A and 7B are sections taken along a line VII—VII in FIGS. 6A and 6B respectively.
Figure 7B:
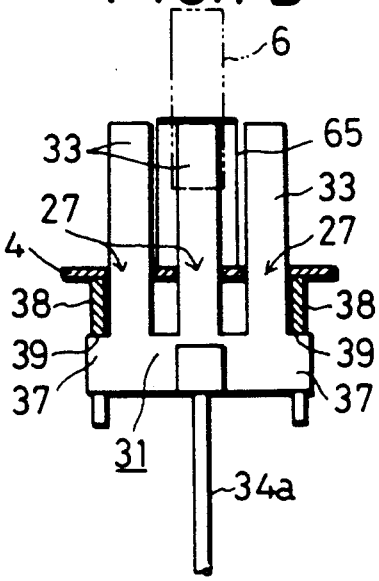

First the supply of a comparatively long twofold label is described in reference to FIGS. 3, 5, 6A, 6B, 7A and 7B. In order to form labels of the above mentioned type, the strip 10 with cutting marks spaced by a larger spacing is used. The cutting means 3 and the label table 4 are moved by the transfer means 21 so that the spacing L1 between the cutter 17 and the push-in element 31 may be half the spacing between above-mentioned cutting marks (half the length of one label element). In this situation, the strip 10 is first moved by the feed rollers 16. As the result of this feed the label element 10*a* corresponding one label is sent out in front of the cutter 17 and rests on the label table 4 as shown in FIGS. 6A and 7A. Next the pistonrod 48*a* of the restricting means 7 is expanded and the label element is pressed down onto the table 4 by the presser bar 49. In this situation, the cutter 17 operates. As a result, the label element on the table 4 is cut off and becomes a label 65. In the label 65, the front end portion 65*a* and the rear end portion 65*b* thereof are sewing end portions and the intermediate portion 65*c* between the end portions is an indicating portion. The strip 10 is beforehand formed so as to yield these portions. The restricting means 7 is released. The pistonrod 34*a* of the cylinder 34 is expanded. Then the push-in element 31 presses the intermediate portion of the label 65 resting on the table 4 as shown in FIGS. 6B and 7B and pushes the intermediate portion into the receiving portion 45 of the retainer 6 through the spacing 47 of the label guides 46. The push-in element 31 continues to advance as far as a position where the abutting member 37 abuts on the stop surface 39. The pushed in label 65 is elastically grasped by the retaining pieces 43 and 43. Then the push-in element 31 is retracted by the contraction of the cylinder 34. The retainer 6 is transversely moved to the sewing position B by the carrier means 42. As shown in FIG. 3, the locus of the movement of the retainer 6 is determined so that the locus of the movement of a part of such a portion 65*d* of the label as protruding downwards from the retainer 6, for example, the locus of the lower half of the portion 65*d* may be obstructed by an object near the sewing position B, for example, by the table 53. Accordingly, when the retainer 6 is moved along the locus of the movement thereof and approaches the sewing position B, the lower half of the protruding portion 65*d* hits on the table 53. As the retainer 6 is moved the protruding portion 65*d* is folded towards the direction opposite to that of the movement of the retainer 6. When the retainer 6 reaches the sewing position B, the sewing end portions 65*a* and 65*b* forming the end portions of the protruding portion 65*d* are overlapped on the sewing edge 64*a* of the cloth 64. In this situation the indicating portion 65*c* of the label 65 is positioned, as a matter of course, over the cloth inside the edge 64*a*. The above mentioned object near the sewing position may be the edge 64*a* of cloth 64. In this case, the locus of the movement of the retainer 6 is determined so that the end portions 65*a* and 65*b* of the label 65 may hit the edge 64*a* of the cloth 64 to be folded backwards as in the above mentioned case.

When the label 65 is supplied in the above mentioned manner, the sewing means 51 operates in the following manner. The cloth presser bar 59 is moved as indicated by arrows 66 in FIG. 2 by the operation of the feed mechanism 60 and the cylinder 58 and presses the cloth 64 and the supplied label 65 down onto the table 53. In this situation, the retainer 6 releases the label 65 and is returned towards the retaining position A. Next the cloth presser bar 59 is moved by the feed mechanism 60 in the direction shown by the arrow 67. As the result of this movement the cloth 64 with the label 65 attached thereon is moved sliding on the upper surface of the table 53 together with the cloth presser bar 59 and reaches the top surface of the machine table 52. The cloth 64 is further slid on the table 52. During the process of this movement, the machine head 54 sews the sewing end portion of the label 65 down onto the edge 64*a* of the cloth 64. When the sewing work is completed the cloth presser bar 59 is raised by the cylinder 58 and the cloth 64 is released. The released cloth 64 is carried for the next step.

The above mentioned work of supplying and sewing the label is repeated one after another and one label is attached on each of many pieces of cloth.

Figure 8A:
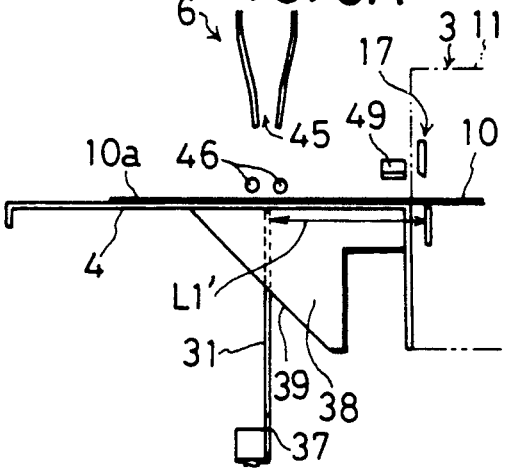
FIGS. 8A and 8B are views for explaining the operation of the push-in element in the case wherein a short twofold label is supplied by the label supply apparatus of FIG. 1.
Figure 8B:
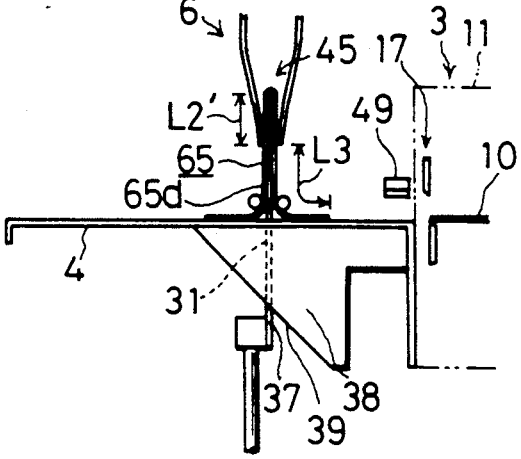

Next the operation in the case when the label is changed, for example, for one of a smaller length is explained. The strip 10 used in this case is the strip having cutting marks attached thereon at a smaller spacing. In the supply apparatus 1, the distance between the cutter 17 and the push-in element 31 is decreased by the transfer means 21 to a small value as shown by L1' in FIG. 8A. Namely this distance is set equal to half the spacing between adjacent cutting marks on the new strip. In this situation the same operations as in the previous case are performed. The situations in this case are as shown in FIGS. 8A and 8B. These figures show situations corresponding to those in FIGS. 6A and 6B. In the case of the present operations, the advance of the push-in element 31 is restricted by the abutment of the abutting member 37 on the stop surface 39 while the advance stroke of the element 31 is still small. The admission depth of the push-in element 31 into the label receiving portion 45 is limited to a small value L2' as shown in FIG. 8B compared with the depth L2 as shown in FIG. 6B. The reduction in the admission depth of the push-in element 31 in the case of FIG. 8B compared with the depth in FIG. 6B is equal to the reduction (L1—L1') in the distance between the cutter 17 and the push-in element 31 since the stop surface 39 is so formed as to be inclined by an angle of 45°. As the result the length L3 of such portion 65*d* of the label protruding from the retainer 6 remains equal to the corresponding length in FIG. 6B. Accordingly when the retainer 6 is moved to the sewing position B, the sewing end portion of the labels 65 is overlapped on the edge of the cloth similarly as in the case of the above mentioned long label. The length L3 is referred to as a necessary protrusion length.

Onefold label are formed in the label supply apparatus 1 and can be supplied to the sewing means 51. The strip used in this case is formed so that the rear end portion of the label cut off at a mark (the end portion adjacent to the cutter 17) may become the sewing end portion and the other portion the indication portion.

Figure 10A:
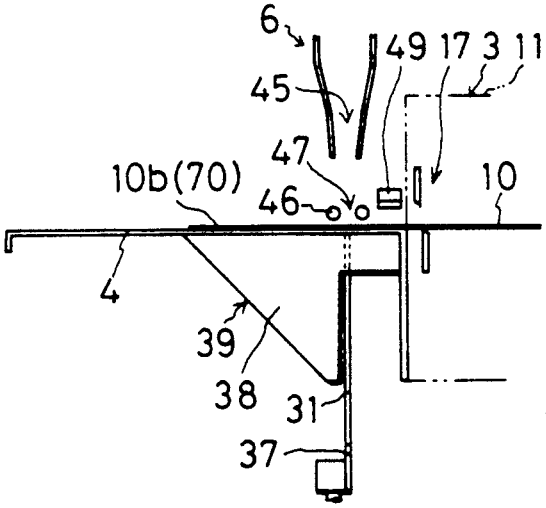
FIGS. 10A and 10B are views for explaining the operation of the push-in element in the case when a long onefold label is supplied by the label supply apparatus of FIG. 1.
Figure 10B:
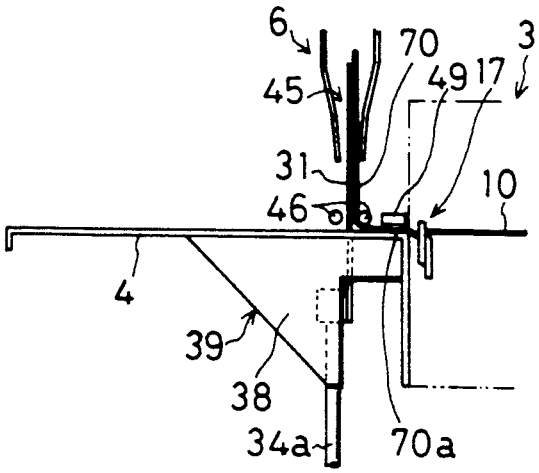
Figure 11:
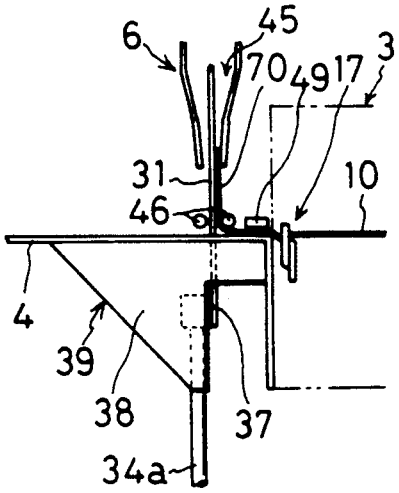
FIG. 11 is a view for explaining the operation of the push-in element in the case when a short onefold label is supplied by the label supply apparatus of FIG. 1.

The onefold label is formed and supplied with the cutting means 3 and the label table 4 moved by the transfer means 21 to the positions shown in FIGS. 10A, 10B and 11. At these positions, the distance from the bottom end of the retainer 6 through the spacing 47 between the label guides 46 to the cutter 17 is equal to the aforementioned length L3 (=L1-L2). When the table 4 is at the above mentioned position the stop member 38 is already retreated from above the abutting member 37. Accordingly the push-in element 31 can advance to the uppermost position.

Figure 9:
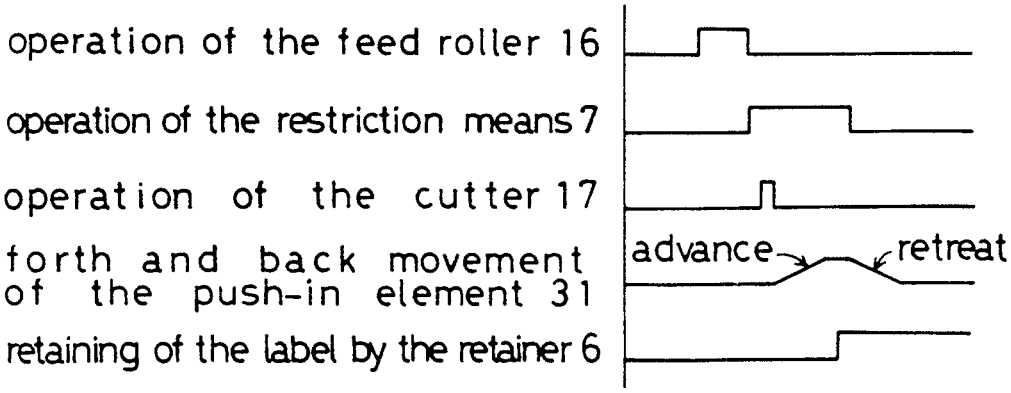
FIG. 9 is a timing chart showing the operation sequences of various portions of the label supply apparatus of FIG. 1 in the case when a onefold label is supplied by the label supply apparatus.

The onefold label is formed and supplied by respective means operating in the sequence of operations of FIG. 9. The point of difference from the case of the aforementioned twofold label (FIG. 5) is that the restricting means 7 is always restricting the label in the whole process of cutting by the cutter 17 and the advancing of the push-in element 31.

As shown in FIG. 10A, a label element 10*b* corresponding to one label is first sent out onto the table 4 similarly as in the case of the twofold label. The label element is then cut by the cutter 17 into a label 70. At this time the rear end portion i.e. the sewing end portion 70*a* of the label 70 on the table 4 is restricted by the press bar 49 as shown in FIG. 10B. With the sewing end portion thus restricted, the push-in element 31 advances to the upper most position thereof as shown in FIG. 10B. Then the other end portion of the label 70 enters the receiving portion 45 in the retainer 6. The retainer 6 clips the label 70. Then the restriction of the sewing end portion is released and further the push-in element 31 is pulled out. In this manner there results a situation where the retainer 6 is retaining the label 70. In this case, since the table 4 is at the above mentioned position, the length of such a portion of the label 70 protruding from the retainer 6 is the same as that in the case of the twofold label. This label 70 is supplied towards the sewing means 51 as in the case of the twofold label.

The operation of the label supply apparatus 1 supplying a short onefold label is quite similar as in the previous case. In this case, the length of such portion of the label as entering the receiving portion 45 of the retainer 6 is shorter than that in the previous case, as shown in FIG. 11. The length of the portion protruding from the retainer 6, however, is the same as in the case of the above mentioned long label.

Figure 12:
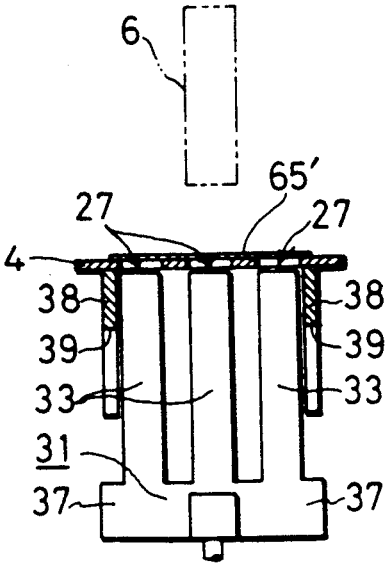
FIG. 12 is a longitudinal section showing the relationship among a wide label, a label table and the push-in element.

The push-in element 31 in the label supply apparatus 1 is made pectinate. Accordingly, a wide label 65' can be put on the label table 4 and can be pushed by the push-in element 31 as shown in FIG. 12.

Those members which are considered functionally the same as or constructionally equivalent to the members in the previous embodiment are given reference numerals the same as in the previous embodiment, but with the letter e affixed and the explanation of the members is not repeated.

Figure 13:
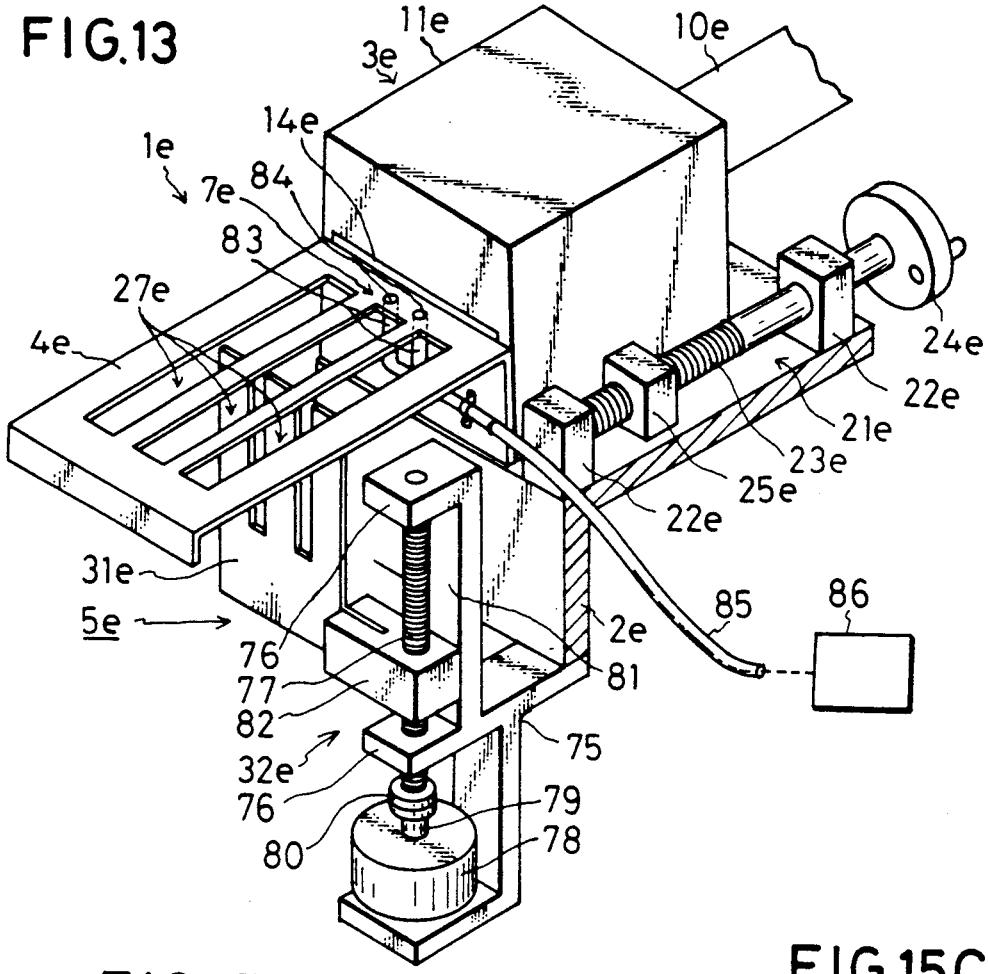
FIG. 13 is a perspective view showing a second embodiment of the label supply apparatus.

A second embodiment of the label supply apparatus is shown in FIG. 13. A label supply apparatus 1*e* shown in this figure is different, reciprocation means 32*e* in a push-in means 5*e* and restricting means 7*e* from the label supply apparatus in the previous embodiment. The reciprocation means 32*e* is first explained. A support frame 75 is mounted on a base frame 2*e*. The support frame 75 includes a pair of bearings 76 and 76 and a feed threaded rod 77 supported for rotation on these bearings. A motor 78 is mounted on the support frame 75 and the output shaft 79 of the motor is connected to the threaded rod 77 by a coupling 80. A movable member 82 is provided for vertical movement along a guide portion 81 in the support frame 75. The push-in element 31*e* is connected to this movable element 82. The movable element 82 is screwed to the threaded rod 77. A motor 78 is used whose number of rotations or angle of rotation of the output shaft 79 can be controllable such as a stepping motor.

In the reciprocation means 32*e* of this type, the advance distance of the push-in element 31*e* can be controlled very precisely by the control of the number of rotations or the angle of rotation of the motor 78. Namely the motor 78 functions to limit the advance stroke of the push-in element 31*e*.

The restricting means 7*e* is so constructed as to restrict the label by vacuum adsorption. Namely a suction pipe 83 is attached to a label table 4*e* and one end of the pipe, as an adsorption member 84, is opened in the top surface of the table 4*e* near an outlet 14*e* in a cutting means 3*e*. One end of a suction tube 85 is connected to the other end of the pipe 83 and a suction means 86 is connected to the other end of the tube 85.

Figure 14:
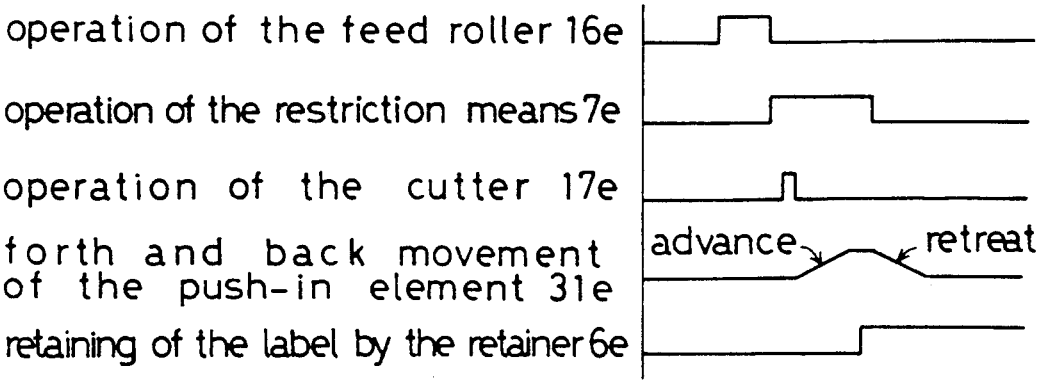
FIG. 14 is a timing chart showing the operation sequences of various portions of the label supply apparatus of FIG. 13 in the case when the twofold label is supplied by the label supply apparatus.
Figure 15A:
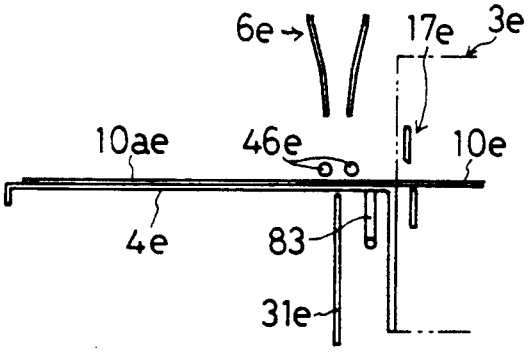
FIGS. 15A through 15C are views for explaining the operation of the push-in element in the case when the twofold label is supplied by the label supply apparatus of FIG. 13.
Figure 15C:
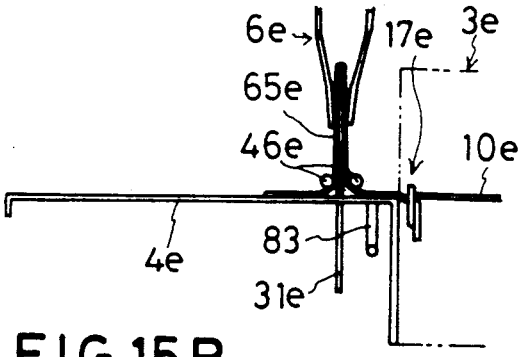
Figure 15B:
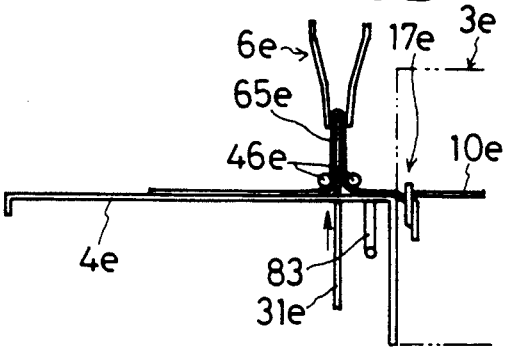

The twofold label or onefold label can be supplied in this label supply apparatus by the same operation as in the above mentioned label supply apparatus. The twofold label can be supplied in the following manner as well. Namely the label table 4*e* is positioned as shown in FIGS. 15A through 15C in the same manner as in the case of the supply of the onefold label in the previously mentioned embodiment. Each means operates in the same sequence of operations as shown in FIG. 14 as in the case of the supply of the above mentioned onefold label. In the case of these operations the push-in element 31*e* advances from the state in FIG. 15A to the states in FIGS. 15B and 15C. The push-in element 31*e* stops at a position where the lengths of the portions of a label 65*e* situated at the right hand and left hand sides of the element 31*e* are equal to each other as shown in FIG. 15C. The advance of this type can be carried out by controlling the number of rotations or the angle of rotation of the motor 78 by means of a control means not shown in accordance with the length of the label 65*e*.

(In what follows, reference numerals with the letter f, g or so are used and the explanation of the same or equivalent members is not repeated.)

Figure 16:
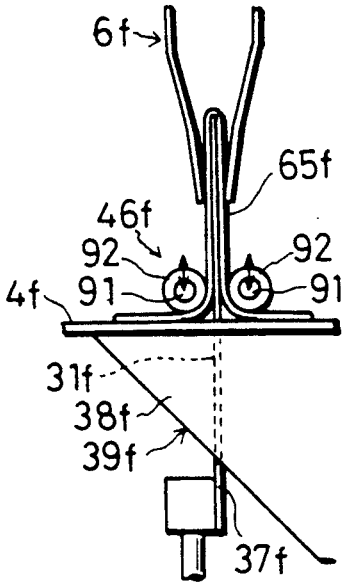
FIG. 16 is a front elevation showing another embodiment of the label guide.
Figure 17:
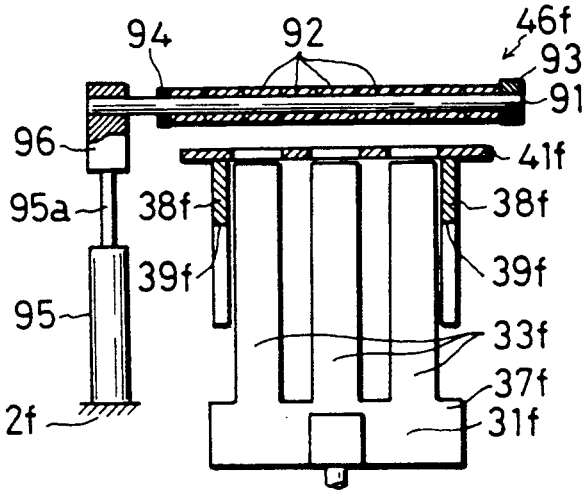
FIG. 17 is a longitudinal section of the label guide of FIG. 16.

A different embodiment of the label guide is shown in FIGS. 16 and 17. This label guide 46*f* can be used, for example, in stead of the label guide in the label supply apparatus in FIG. 3. The label guide 46*f* comprises axial rods 91 and 91 with a number of rollers 92 mounted respectively thereon for rotation. Each roller 92 is adapted to be prevented from dropping from the axial rod 91 by stoppers 93 and 94 fixed on the axial rod 91. The axial rod 91 is connected by a fixture 96 to a pistonrod 95*a* of a hydraulic cylinder 95 mounted on a base frame 2*f* and is moved up and down as the pistonrod 95*a* reciprocates.

Figure 18:
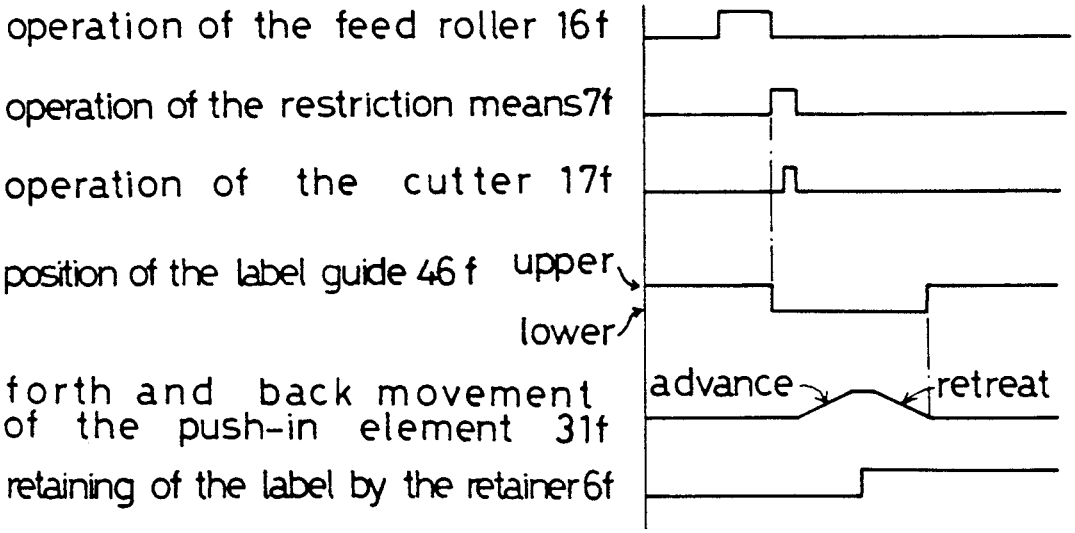
FIG. 18 is a timing chart showing the operation sequences of various portions of a label supply apparatus provided with the label guide of FIG. 16 in the case when the twofold label is supplied by the label supply apparatus.

The label is supplied in the label supply apparatus including the label guide 46*f* when each means operates in accordance with the sequence of operations as shown in FIG. 18. These operations, except for the vertical movement of the label guide 46*f*, are the same as those in the label supply apparatus in FIG. 3 (refer to FIG. 5). When the strip is fed, the label guide 46*f* is at a raised position. Accordingly the strip can pass under the label guide 46*f* without hindrance. When the strip has been fed and the restricting means restricts the strip, the label guide 46*f* is lowered and rests on the strip. In this situation the strip is cut into a label and thereafter the push-in element advances. Accordingly a label 65*f* remains pressed on the label table by the label guides 46*f*. As a result, an accident whereby the label slips out from the top surface of the label table can be prevented. In this case, since the rollers 92 are rotatable, the label 65*f* moves without hindrance when the push-in element advances.

The label guide 46*f* is provided with a plurality of rollers 92. Accordingly, when the label is narrow, only the roller in contact with the label can rotate independently. Thus the narrow label can be smoothly moved.

Figure 19:
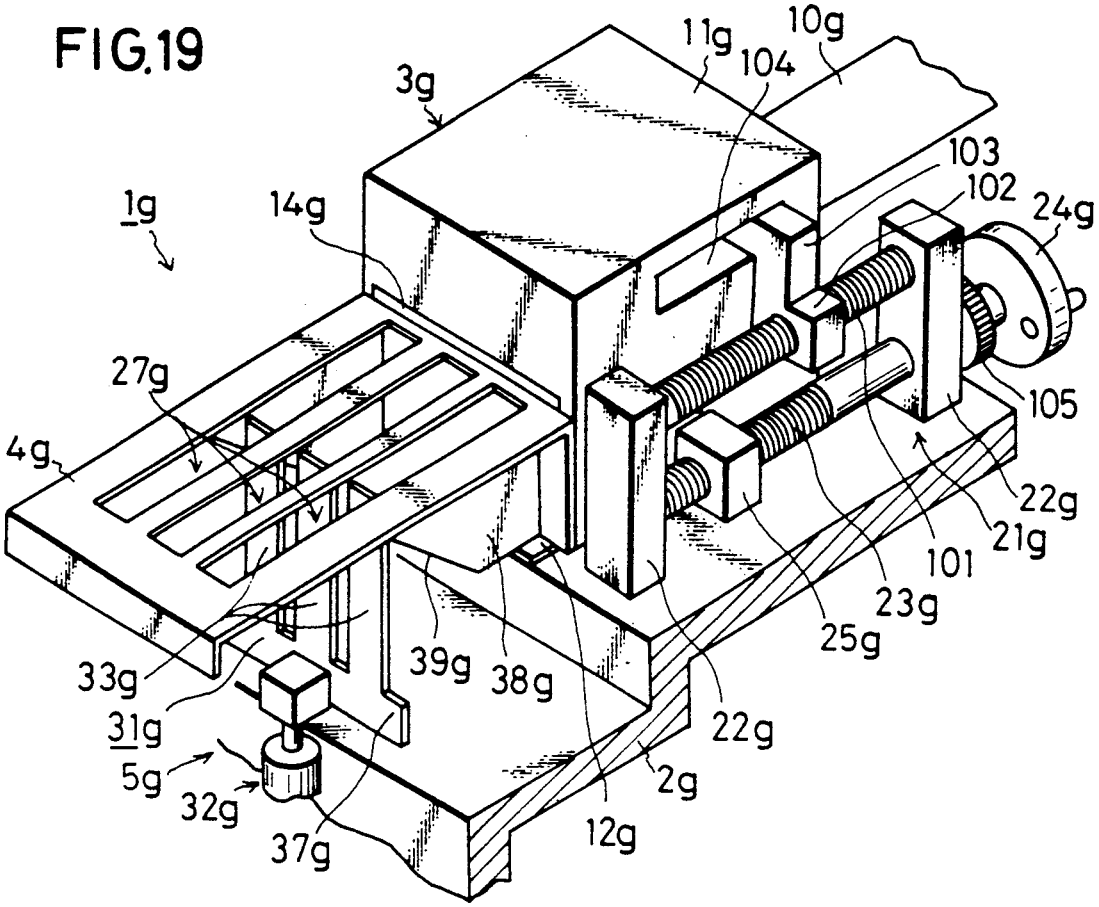
FIG. 19 is a perspective view showing a third embodiment of the label supply apparatus.
Figure 20:
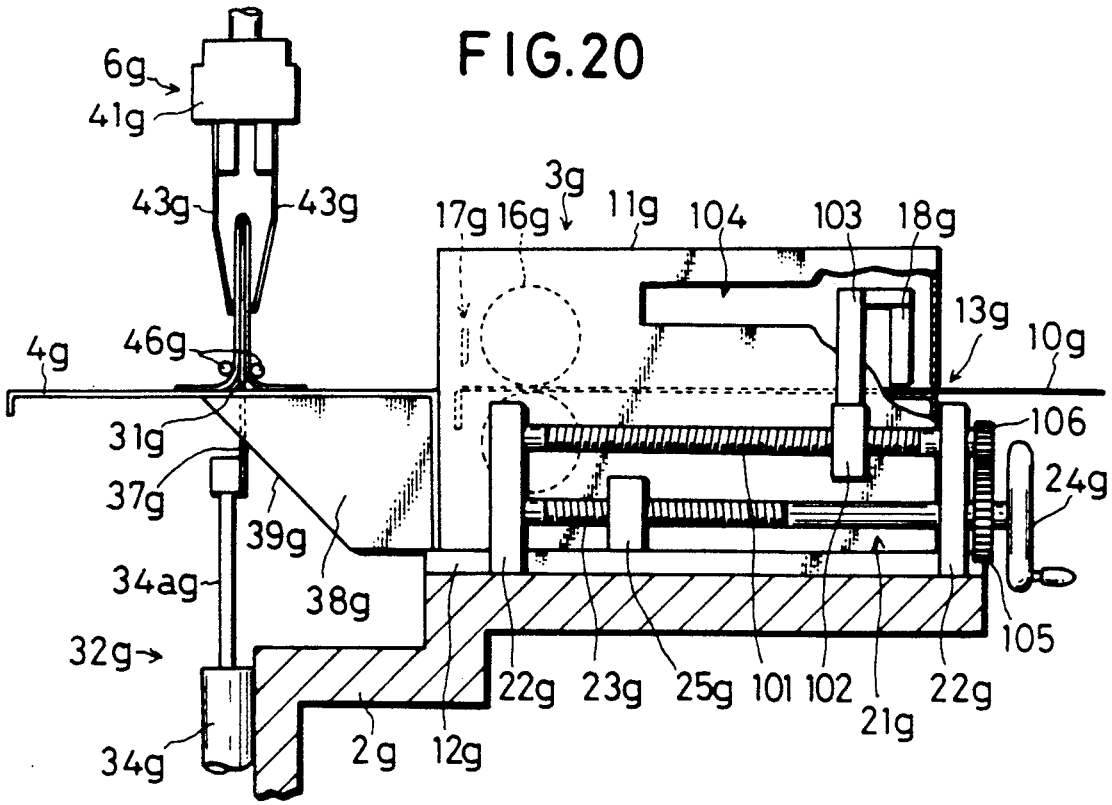
FIG. 20 is a side elevation in partial section of the label supply apparatus of FIG. 19.

A third embodiment of the label supply apparatus is shown in FIGS. 19 and 20. This label supply apparatus 1*g* comprises a transfer means 21*g* different in construction from that in the label supply apparatus in FIG. 1. A feed rod 101 is supported for rotation by a pair of bearings 22*g* and 22*g*. The feed rod 101 consists of a threaded rod. A movable element 102 is screwed on the feed rod 101. One end of connection rod 103 is connected to the movable element 102. The other end of the connection rod 103 is inserted into a housing 11*g* through an aperture 104 formed in the housing 11*g* and is connected to a mark sensor 18*g*. A feed rod 23*g* and the feed rod 101 are formed with a right-handed screw and a left-handed screw of the same pitch respectively. Gears 105 and 106 are mounted on the rods 23*g* and 101 respectively in order to link both rods. The gear ratio of the gears 105 and 106 is 3:1.

Figure 21:
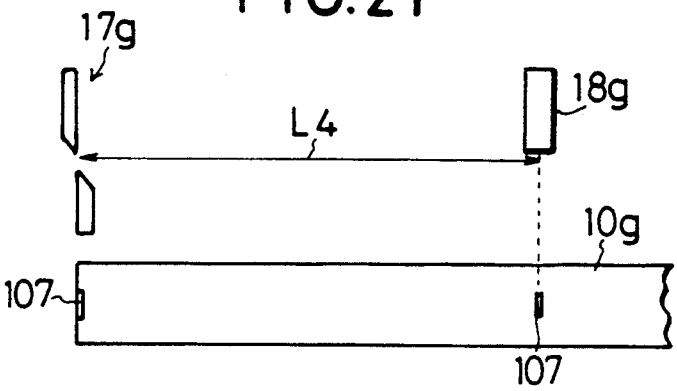
FIG. 21 is a view for explaining the operation of a mark sensor in the label supply apparatus of FIG. 19.

This label supply apparatus is different in the linkage relationship between the mark sensor 18*g* and a feed roller 16*g* from the label supply apparatus shown in FIG. 1. This relationship is explained in reference with FIG. 21. In this example, if the mark sensor 18*g* detects a mark 107 while the feed roller 16*g* is feeding a strip 10*g*, the feed of the strip 10*g* is stopped. Accordingly the mark 107 can be located just at the position of a cutter 17*g* by making the distance L4 between the cutter 17*g* and the sensor 18*g* be equal to the distance between two adjacent marks 107.

Since the feed rods 23*g* and 101 and gears 105 and 106 are constructed as mentioned above in the above label supply apparatus, the housing 11*g* and the sensor 18*g* are moved in the same direction when the transfer means 21*g* is operated. Besides the ratio of the moving distances of these members 11*g* and 18*g* becomes 1:3. When the label supply apparatus is used, the transfer means 21*g* is operated in accordance with the strip used so that the distance between the mark sensor 18*g* and the cutter 17*g* may coincide with the spacing between the marks 107. Then the spacing between a push-in element 31*g* and the cutter 17*g* becomes automatically half the spacing between the marks 107 (the length of the label). The midpoint of the label cut off is opposite the push-in element 31*g*.

Figure 22:
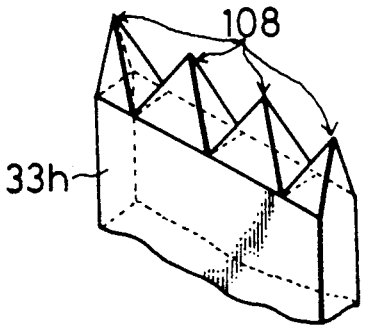
FIGS. 22 and 23 are perspective views showing different examples of the form of the end portion of the push-in tooth.
Figure 23:
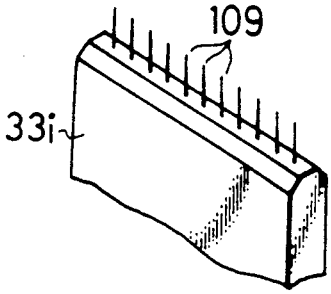

Examples of the form of the end portion of the push-in teeth are shown in FIGS. 22 and 23. In the example of FIG. 22, tip portions 108 are formed on the tops of push-in teeth 33*h*. In the example of FIG. 23 a plurality of needles 109 are provided at the tops of push-in teeth 33*i*. When these tops push the middle of the label the tips 108 or the needles 109 catch (stick into) the label. As a result the label is prevented from slipping away transversely.

Figure 24:
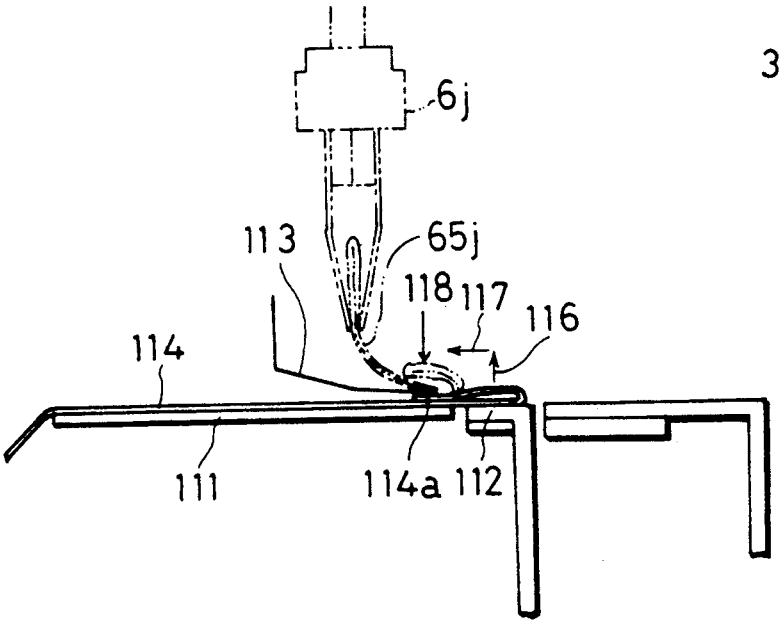
FIG. 24 is a view for explaining the hem folding operation by a hem folding apparatus and FIGS. 25 and 26 are views showing examples of different types of movement of a retainer.

In FIG. 24 a folded hem forming means is shown as another example of the means to receive the supplied label. This means is a known one (for example disclosed in Japanese published examined patent application No. 59-46194) and comprises a table 111, a folder 112, a ruler 113 and so on. A label 65*j* is carried by a retainer 6*j* and a sewing end portion 65a*j* is positioned relative to a already folded edge 114*a* of a cloth (for example a towel) as shown in the figure. The edge 114*a* is folded up on the ruler 113 in the form as shown by two-dot chain lines by the folder 112 moved in the directions shown by arrows 116 and 117. After the ruler 113 has been removed a portion indicated by a numeral 118 is sewn.

Figure 25:
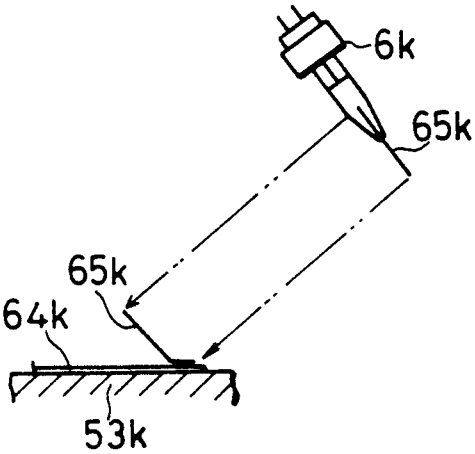
Figure 26:
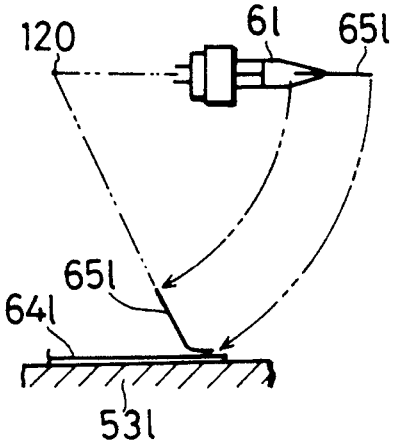

An oblique movement of the retainer as shown in FIG. 25 or a circular movement centered at a point 120 as shown in FIG. 26 may be possible other than the above mentioned transverse movement.

What is claimed is:

1. A label supply apparatus comprising:

a label rest position for supporting a label;

a retainer located opposite a label supported on said label rest position;

a push-in element provided at one side of said label rest position, opposite a side supporting said label, said push-in element being supported to advance towards and away from said one side, extending through an opening in said label rest position so that said push-in element pushes a portion of a said label supported on said label rest position into said retainer, whereby said retainer clips said portion of said label; and, means for moving said retainer towards a sewing position over a locus of movement so that an end portion of said label protruding from said retainer hits an object situated near said sewing position, folding said label in a direction opposite the direction of movement of said retainer.

2. A label supply apparatus as set forth in claim 1 including a restricting means for temporarily restricting movement of one end of said label with respect to said label rest position.

3. A label supply apparatus as set forth in claim 1 including a prescription means for limiting a stroke of advance of said push-in element within a prescribed length.

4. A label supply apparatus as set forth in claim 1 including a cutting means for cutting labels off from a long strip and placing said cut-off labels on said label rest position.

5. A label supply apparatus as set forth in claim 4, wherein said cutting means is adapted to cut labels of different length from said strip, and wherein a prescription means for limiting a stroke of advance of said push-in element within a prescribed length is provided, connected to said cutting means so that the prescribed length limiting said stroke is varied in accordance with the length of the label cut off in said cutting means.

6. A label supply method comprising:

placing a label at a label rest position with the middle of said label opposing a push-in element;

advancing said push-in element to push an intermediate portion of said label into a retainer located above said label with end portions of said label remaining outside said retainer;

holding said pushed-in label in said retainer while retracting said push-in element; and, moving said retainer along a locus of movement to overlap said end portions of said label protruding from said retainer over a cloth to which said label is to be sewn, folding said end portions in a direction opposite the direction of movement of said retainer towards a prescribed sewing position.

7. A label supply method comprising: placing a label at a label with two ends rest position so that a distance between a pushed-in element and one end of said label is equal to a prescribed distance, restricting movement of one end of said label to said label rest position by a restricting means, advancing said push-in element to push an intermediate portion of said label into a retainer until said label ends protrude from said retainer by an equal length, holding said pushed-in label in said retainer while retracting said push-in element and moving said retainer along a locus of movement to overlap said label ends protruding from said retainer with a cloth to be sewn to said label, and folding said label ends in a direction opposite to the direction of movement of said retainer toward a prescribed sewing position.

* * * * *